US010016993B2

(12) United States Patent
Weismantel

(10) Patent No.: US 10,016,993 B2
(45) Date of Patent: Jul. 10, 2018

(54) ELASTIC BENDING MECHANISM FOR BI-DIRECTIONAL ADJUSTMENT OF PRINT HEAD POSITION

(71) Applicant: Electronics for Imaging, Inc., Fremont, CA (US)

(72) Inventor: John A. Weismantel, Gilford, NH (US)

(73) Assignee: ELECTRONICS FOR IMAGING, INC., Fremont, CA (US)

( * ) Notice: Subject to any disclaimer, the term of this patent is extended or adjusted under 35 U.S.C. 154(b) by 0 days.

(21) Appl. No.: 15/597,495

(22) Filed: May 17, 2017

(65) Prior Publication Data

US 2017/0341439 A1 Nov. 30, 2017

Related U.S. Application Data

(60) Provisional application No. 62/340,993, filed on May 24, 2016.

(51) Int. Cl.

| | |
|---|---|
| ***B41J 25/308*** | (2006.01) |
| ***B41J 25/316*** | (2006.01) |
| ***B41J 25/34*** | (2006.01) |
| ***B41J 25/00*** | (2006.01) |
| ***B41J 29/02*** | (2006.01) |

(52) U.S. Cl.

CPC ..... *B41J 25/308* (2013.01); *B41J 25/001* (2013.01); *B41J 25/003* (2013.01); *B41J 25/3082* (2013.01); *B41J 25/3088* (2013.01); *B41J 25/316* (2013.01); *B41J 25/34* (2013.01); *B41J 29/02* (2013.01)

(58) Field of Classification Search

CPC ..... B41J 25/001; B41J 25/003; B41J 25/308; B41J 25/3082; B41J 25/3088; B41J 25/316; B41J 25/34; B41J 29/02

See application file for complete search history.

(56) References Cited

U.S. PATENT DOCUMENTS

| | | | | |
|---|---|---|---|---|
| 4,570,168 | A * | 2/1986 | Sjordal | B41J 29/02 33/645 |
| 6,382,752 | B1 * | 5/2002 | Riou | B41J 25/304 347/37 |
| 9,586,424 | B2 * | 3/2017 | Campbell | B41J 25/001 |
| 2016/0031238 | A1 | 2/2016 | Campbell et al. | |

* cited by examiner

*Primary Examiner* — Anh T. N. Vo
(74) *Attorney, Agent, or Firm* — Perkins Coie LLP

(57) ABSTRACT

Mechanisms for adjusting the position of one or more print heads at an extremely fine resolution (e.g., less than 10 μm) are described herein. The adjustment mechanisms include a differential screw and an indexing wheel through which the differential screw extends. One threaded segment of the differential screw is connected to a threaded feature of a flexible body that is coupled to the print head(s), while another threaded segment of the differential screw is connected to a threaded feature of a rigid body that is coupled to a printer assembly. As the indexing wheel and differential screw rotate, the space between the flexible body and the rigid body changes based on the difference between the pitches of the threaded segments. The adjustment mechanisms described herein utilize the accurate, consistent motion of the flexible body upon experiencing pressure to effect predictable changes in the position of the print head(s).

24 Claims, 9 Drawing Sheets

ELASTIC BENDING MECHANISM FOR BI-DIRECTIONAL ADJUSTMENT OF PRINT HEAD POSITION

CROSS-REFERENCE TO RELATED APPLICATIONS

This application claims priority to and the benefit of U.S. Provisional Application No. 62/340,993 titled "Elastic Bending Mechanism for Bi-Directional Fine Adjustment of Print Head Position" and filed on May 24, 2016.

RELATED FIELD

Various embodiments relate to print head positioning. More specifically, various embodiments concern elastic bending mechanisms for bi-directional adjustment of print head position.

BACKGROUND

Inkjet printing is a type of computer printing that recreates a digital image by depositing droplets of ink onto a substrate, such as paper or plastic. Many contemporary inkjet printers utilize drop-on-demand (DOD) technology to force droplets of ink from a reservoir through a nozzle onto the substrate. Accordingly, the mounting and positioning of the reservoir and nozzle (among other components) is critical to accurately depositing drops of ink in the desired position. Together, these components form a print head (also referred to as a "print head assembly").

Inkjet printers must position individual droplets of ink with high accuracy and precision in order to output images of acceptable quality. However, sufficient accuracy and precision are often difficult to achieve using conventional manufacturing techniques, which often result in inconsistent placement of printer components and poor print quality.

There are many possible sources of error that can contribute to inaccurate and/or imprecise droplet positioning. For example, one key contributor is the physical position of each print head with respect to all six degrees of freedom when mounted inside an inkjet printer housing or printing mechanism. Adjustment mechanisms are commonly used to adjust or align the position of a single print head or multiple print heads within an array.

The desired image quality drives the accuracy requirements and/or precision requirements that a given adjustment mechanism must provide. For example, position tolerance requirements are commonly less than 10 microns (μm), though some applications may require significantly less. Conventional adjustment mechanisms include finely threaded screws, incline planes, cams, eccentric pins, differentials screws, etc., that act against an opposing preloaded force, which is typically applied by a spring. Relative motion between different bodies can then be controlled in multiple degrees of freedom by contacting surfaces that slide against one another. Locking devices, such as screws, are typically used to secure the different bodies in the desired arrangement after adjustment.

However, conventional adjustment mechanisms for adjusting the position of print heads are largely unable to address several challenges. For example, because the resulting position of the print head must be measured to great accuracy, the adjustment mechanism must have very fine resolution. Bodies or surfaces that slide against one another are inherently over-constrained due to flatness or form errors that exist along the surfaces. As another example, changes in the final position can be influenced when locking screws are loosened and tightened. Therefore, resolution of any adjustments is limited due to friction of the sliding surfaces as differences in static friction and dynamic friction between the bodies creates hysteresis.

Mechanical components (e.g., screws, cams, and incline planes) that act to push or pull a body relative to another body must have a means to control undesirable motion in other degrees of freedom. Accurate linear or rectilinear motion requires tight-tolerance parts or features and suffers the same drawbacks of friction between opposing parts, features, surfaces, bodies, etc. Opposing preload forces are required to nest the moving body against the adjuster. Such opposing preload forces are typically provided by a spring. Such a configuration requires higher quantities of parts and larger volumes to fit the parts as compared to an inherently preloaded design. Moreover, adjustment mechanisms typically require more physical parts and time to perform the alignment. The level of skill required by an operator or technician to perform an alignment is high due to potential variations in the adjustment process and tool operation details.

SUMMARY

Described herein are mechanisms for adjusting the position of one or more print heads at an extremely fine resolution (e.g., less than 10 μm). The adjustment mechanisms include a differential screw and an indexing wheel through which the differential screw extends. One threaded segment of the differential screw is connected to a threaded feature of a flexible body that is coupled to the print head(s), while another threaded segment of the differential screw is connected to a threaded feature of a rigid body that is coupled to a printer assembly. As the indexing wheel and differential screw rotate, the space between the flexible body and the rigid body changes based on the difference between the pitches of the threaded segments. The adjustment mechanisms described herein utilize the accurate, consistent motion of the flexible body upon experiencing pressure to effect predictable changes in the position of the print head(s), while also reducing the labor skill required to align the print head(s).

The flexible body (also referred to as an "elastic bending mechanism") improves adjustment efficiency by providing an individual (e.g., an operator or a technician) with an intuitive mechanism by which to modify the position of the print head(s). In some embodiments, the indexing wheel provides visual feedback, audible feedback, and/or tactile feedback that allows the individual to make more accurate discrete adjustments of the print head(s). The detents of the indexing wheel simplify the process of adjusting the print head(s) and allow the adjustment to be quickly completed in a small number of steps. Among other benefits, tactile detents can prevent inadvertent adjustments and enable discrete adjustment increments. Moreover, the visual feedback, audible feedback, and/or tactile feedback provided by the indexing wheel gives the individual up to three different senses of feedback to improve the ease with which adjustments are made and reduce total error and the number of steps in the alignment process.

BRIEF DESCRIPTION OF THE DRAWINGS

One or more embodiments of the present disclosure are illustrated by way of example and not limitation in the figures of the accompanying drawings, in which like references indicate similar elements.

DETAILED DESCRIPTION

Figure 1:
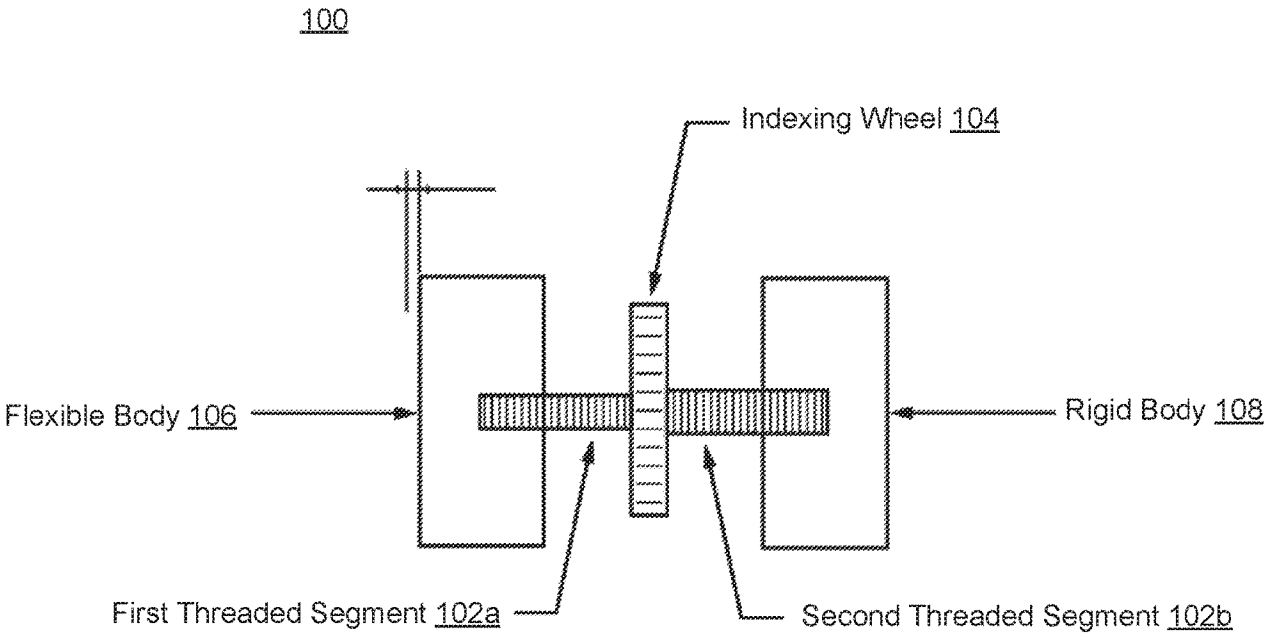
FIG. 1 is a top view of a mechanism that can be used to adjust the position of a print head within a printer assembly.

Many conventional techniques for adjusting the position of one or more print heads within a printer assembly require expensive tight-tolerance machined components and long lead times. Another approach to achieving accurate positioning is to utilize one or more alignment mechanisms, In such instances, the tolerances of some or all of the printer components are kept relatively loose and then subsequently adjusted using the adjustment mechanism(s) after installation within the printer assembly.

Adjustment mechanisms are typically developed to position or confine multiple bodies (i.e., printer components) in a particular arrangement. Therefore, an adjustment mechanism may include structural components such as screws, eccentric cams, incline planes, etc. These structural components are typically secured to one or both bodies using hardware (e.g., a screw) that preloads the adjustment mechanism. For example, in order to subsequently modify the alignment of multiple bodies, an individual (e.g., an operator or a technician) may loosen a screw, and then adjust the position by turning a fine adjustment screw or cam and sliding one body against another. Springs are often used to preload movable bodies against the adjustment mechanism and/or the hardware used to secure the structural components.

However, using adjustment mechanism(s) to align the position of the print head(s) poses a number of challenges. For example, the adjustment mechanism(s) must have very fine resolution, and the resulting position must be measured to great accuracy. Moreover, many adjustment mechanisms include parts or surfaces that slide against one another or are secured to one another (e.g., using fasteners, screws, or springs). This approach limits achievable resolution due to the friction of the opposed surfaces sliding against each other. The inherent over-constraint of two mating surfaces with unavoidable flatness error also results in changes to position when the fasteners, screws, etc. are loosened and re-tightened. Each of these issues can result in an error that is several magnitudes greater than the desired positional resolution.

Accordingly, described herein are mechanisms for adjusting the position of one or more print heads at an extremely fine resolution (e.g., less than 10 μm). The adjustment mechanisms include a differential screw and an indexing wheel through which the differential screw extends. One threaded segment of the differential screw is connected to a threaded feature of a flexible body that is coupled to the print head(s), while another threaded segment of the differential screw is connected to a threaded feature of a rigid body that is coupled to a printer assembly. As the indexing wheel and differential screw rotate, the space between the flexible body and the rigid body changes based on the difference between the pitches of the threaded segments. The adjustment mechanisms described herein utilize the accurate, consistent motion of the flexible body upon experiencing pressure to effect predictable changes in the position of the print head(s), while also reducing the labor skill required to align the print head(s).

Several advantages exist when positioning of the print head(s) is controlled using a flexible body (e.g., an elastic bending mechanism). First, elastic bending eliminates friction and allows the achievable resolution to be orders of magnitude better than conventional sliding bodies. Second, flexible bodies can be designed so that they are inherently preloaded (i.e., will remain in an equilibrium position until a force is applied). Third, flexible bodies improve adjustment efficiency by providing an individual (e.g., an operator or a technician) with an intuitive mechanism by which to modify the position of the print head(s).

Embodiments of the technology described herein provide improved accuracy and positioning of print head(s) within a printer assembly, thereby resulting in improved image quality. Other benefits include a reduction or elimination of the need for different alignment mechanisms (thereby resulting in improved product-output standardization), improvements in serviceability of print head installation and replacement, reductions in the labor skill level required to service printer assemblies, and an ability to consistently and accurately adjust the position of print head(s) without changing the stresses experienced by other printer components.

Terminology

Brief definitions of term, abbreviations, and phrases used throughout the application are given below.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments necessarily mutually exclusive of other embodiments. Moreover, various features are described that may be exhibited by some embodiments and not by others. Similarly, various requirements are described that may be requirements for some embodiments and not for other embodiments.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of (or connection between) the elements can be physical, logical, or a combination thereof. For example, two components may be coupled directly to one another or via one or more intermediary channels or components. As another example, devices may be coupled in such a way that the devices do not share a physical connection with one another.

Additionally, the words "herein," "above," "below," and words of similar import, when used in this application, shall refer to this application as a whole and not to any particular portions of this application. Where the context permits, words in the Detailed Description using the singular or plural number may also include the plural or singular number respectively. The word "or," in reference to a list of two or more items, covers all of the following interpretations of the word: any of the items in the list, all of the items in the list, and any combination of the items in the list.

If the specification states a component or feature "may," "can," "could," or "might" be included or have a characteristic, that particular component or feature is not required to be included or have the characteristic.

The terminology used in the Detailed Description is intended to be interpreted in its broadest reasonable manner, even though it is being used in conjunction with certain examples. The terms used in this specification generally have their ordinary meanings in the art, within the context of the disclosure, and in the specific context where each term is used. For convenience, certain terms may be highlighted, for example using capitalization, italics, and/or quotation marks. The use of highlighting has no influence on the scope and meaning of a term; the scope and meaning of a term is the same, in the same context, whether or not it is highlighted. It will be appreciated that an element or feature can be described in more than one way.

Consequently, alternative language and synonyms may be used for any one or more of the terms discussed herein, and special significance is not to be placed on whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only, and is not intended to further limit the scope and meaning of the disclosure or of any exemplified term. Likewise, the disclosure is not limited to the various embodiments given in this specification.

Differential Screw Overview

FIG. 1 is a top view of a mechanism 100 that can be used to adjust the position of a print head within a printer assembly. The adjustment mechanism 100 includes a differential screw (also referred to as a "spindle") and an indexing wheel 104 through which the differential screw extends. The differential screw has a first threaded segment 102*a* having a first pitch and a second threaded segment 102*b* having a second pitch. The "pitch" of a given segment of the differential screw refers to the distance from the crest of one thread to the crest of the next thread (i.e., the distance the given segment advances when it turns one revolution).

The first threaded segment 102*a* of the differential screw is connected to a threaded feature of a flexible body 106, while the second threaded segment 102*b* of the differential screw is connected to a threaded feature of a rigid body 108. As the differential screw rotates, the space between the flexible body 106 and the rigid body 108 changes based on the difference between the pitches of the first and second threaded segments 102*a-b*. Because the differential screw has two different pitches along a single axis, the differential screw allows very fine spatial adjustments to be made using commonly available screws.

Figure 2:
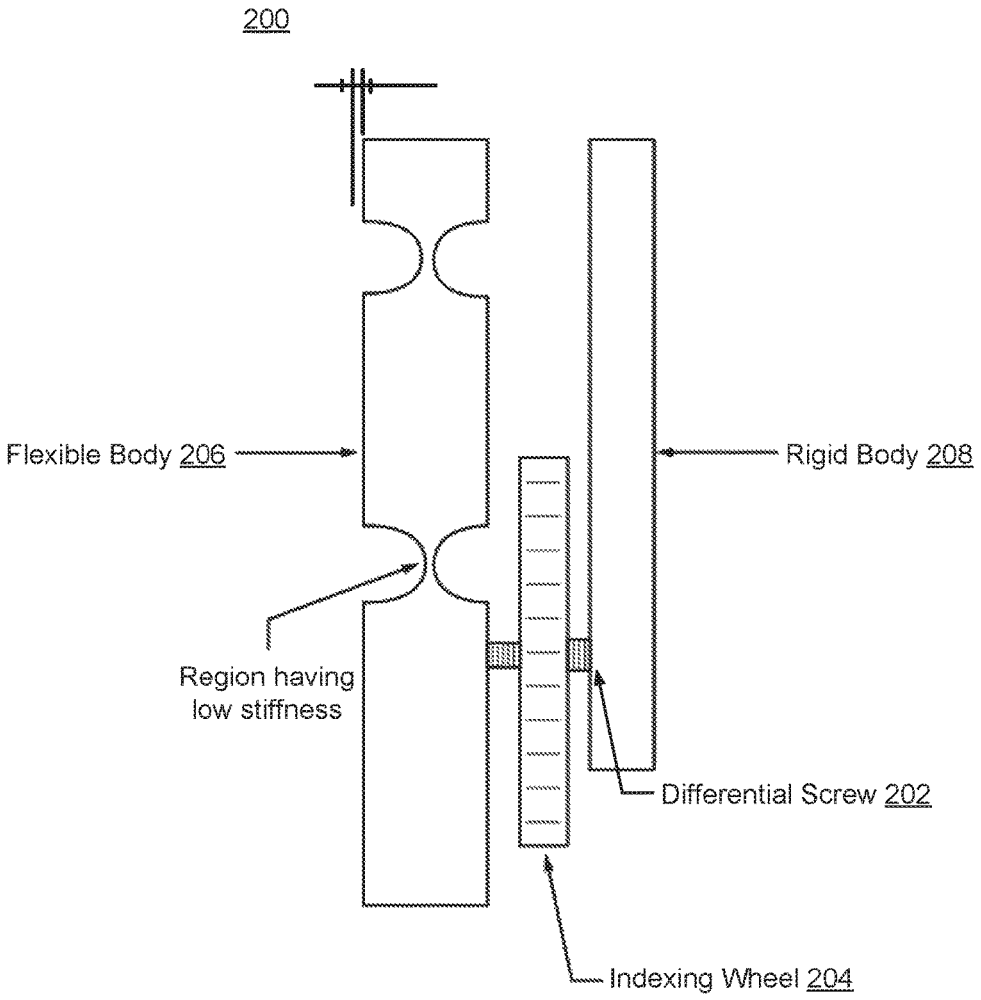
FIG. 2 is a side view of a mechanism that can be used to adjust the position of a print head within a printer assembly.

FIG. 2 is a side view of a mechanism 200 (e.g., adjustment mechanism 100 of FIG. 1) that can be used to adjust the position of a print head within a printer assembly. As noted above, the adjustment mechanism 200 includes a differential screw 202 that extends through an indexing wheel 204 and is connected to a flexible body 206 and a rigid body 208. The flexible body 206 can be coupled to the print head (or an array of multiple print heads), while the rigid body 208 can be coupled to the printer assembly. As further described below, bi-directional adjustment of the print head can be effected by rotating the indexing wheel 204, which causes pressure to be applied to, or relieved from, the flexible body 206 that is coupled to the print head.

In some embodiments, the flexible body 206 includes one or more regions having low stiffness. These region(s) may be composed of a different material and/or include a structural deformity (e.g., a protrusion or cavity). Here, for example, the flexible body 206 is a linear flexure that includes four notches (i.e., regions of low stiffness). The region(s) of low stiffness enable the flexible body 206 to experience localized bending in a desired direction.

The threaded feature of the flexible body 206 (which receives the first threaded segment of the differential screw 202) is often located in a specific position based on application (e.g., spatial constraints within a printer carriage). However, the threaded feature of the flexible body 206 may also be placed in a specific position to optimize one or more of the region(s) of low stiffness. For example, in some embodiments the threaded feature is located equidistant from two regions (e.g., notches) along a single side of the flexible body 206. Such placement represents the optimal location for ensuring efficient and accurate rectilinear motion along a single degree of freedom, while limiting undesired motion along the other degrees of freedom. Other placements may result in larger amount of undesired movement (i.e., motion loss) along the other degrees of freedom.

Additional considerations may also be made for the location of the connection to the bodies. For example, in the embodiment shown in FIG. 2, the connection is made below the notches. This is because the lower section of the flexible body (also referred to as a "flexure component") is held in an accurate position while the connection is made. This assures that the free state position of the flexure component does not influence the initial alignment of the print head. The differential screw connections hold the lower section of the flexure component in place. This is important due to inherent variations that occur across multiple flexure components due to manufacturing tolerances and internal stresses due to fabrication, heat treatments, etc. Here, for example, if the connection point were centered vertically between the notches, then the lower notch would have a preload in one direction. When the assembly is removed from the fixture, the lower section could change position.

As noted above, the differential screw 202 includes multiple segments having different pitches (also referred to as "thread sizes"). The pitch of each threaded segment controls how far the differential screw 202 (and thus the flexible body 206) will advance when it turns a single revolution (or a fraction thereof). Accordingly, when the indexing wheel 204 turns one revolution, the second threaded segment rotates one revolution and moves in a distance equal to the pitch. Since the first threaded segment is on the same differential screw, it moves together with the first threaded segment and also rotates one revolution. However, the first threaded segment of the differential screw 202 is connected to the flexible body 206, which is unable to rotate, so the flexible body 206 retracts a distance equal to the pitch of the first threaded segment. Accordingly, the total displacement of the flexible body 206 is the advance distance of the second threaded segment minus the retracted distance (i.e., the difference between the pitches of the threaded segments).

$$\Delta S_{Flexible\ Body}=(L_2-L_1)\Delta\theta_{Screw}$$

Where:

$\Delta S_{Flexible\ Body}$=Distance traveled by the flexible body (mm);

$L_1$=Pitch of the first threaded segment (mm);

$L_2$=Pitch of the second threaded segment (mm); and $\Delta\theta_{Screw}$=Number of turns of the screw (revolutions).

For example, the rigid body 208 may include a threaded feature designed to receive an M3 screw having a pitch of 0.25 mm, while the flexible body 206 may include a threaded feature designed to receive an M3 screw having a pitch of 0.20 mm. In such embodiments, each revolution of the indexing wheel 204 and the differential screw 202 causes the flexible body 206 to move 0.05 mm (50 μm).

Certain pitch values have been used for the purposes of illustration only. One skilled in the art will recognize that a differential screw having other pitch values could also be used. In fact, pitch values may be selected based on the desired positional resolution (i.e., how far the print head should move per revolution of the differential screw). For example, if the flexible body 206 needs to move 0.10 mm per each turn of the differential screw, threaded segments having different pitch values may be selected (e.g., 0.30 mm and 0.20 mm)

System Overview

In the field of inkjet printing, the position of a print head and its ink-jetting nozzles is crucial to accurately and precisely depositing drops of ink onto a substrate (also referred to as "print media"). Adjustment mechanisms are often used to modify the position of the print head in order to achieve the accuracy and precision necessary for acceptable image quality. Adjustment mechanisms may be used to move a single print head (or an array of multiple print heads) in all six degrees of freedom (i.e., orthogonal displacements X, Y, and Z, as well as rotational displacements Theta-X, Theta-Y, and Theta-Z) or any combination of individual degrees of freedom.

Flexible bodies (also referred to as "elastic bending mechanisms" or "flexures") provide several benefits in comparison to conventional adjustment mechanisms. For example, because flexible bodies move due to elastic bending of a feature (or an arrangement of features) within each flexible body rather than contacting bodies that slide or roll against one another, flexible bodies eliminate the friction that would typically exist between such contacting bodies. The lack of friction enables the theoretical adjustment resolution to be infinite, though the actual adjustment resolution is limited by the pitches available to differential screws. Flexible bodies are also inherently preloaded, which eliminates the need for additional structural components (e.g., springs) that produce forces opposed to motion. In some embodiments, flexible bodies are fabricated from monolithic structures to minimize the total number of parts required within adjustment mechanisms.

Stiffness of the flexible bodies can also be designed such that it exceeds all possible dynamic loads, thereby rendering locking requirements and/or locking parts (e.g., washers and bearings) unnecessary. Stiffness of a flexible body may be tailored to a single degree of freedom or multiple degrees of freedom. Achieving low stiffness in a single degree of freedom, while maintaining high stiff in the other degrees of freedom, can be readily accomplished (e.g., by using a flexible body having a specific arrangement of regions of low stiffness, as shown in FIG. 2). Such techniques enable accurate rectilinear motion along a single degree of freedom to be readily produced for short distances.

FIGS. 3-6 depict a specific implementation of one or more flexible bodies 306 that enable fine bi-directional adjustment in the positioning of one or more print heads 304 as they relate to stitching in a linear array of multiple print heads. Note, however, that this approach can be applied to any alignment of print head(s) and any combination of all six degrees of freedom. "Stitching" refers to the dimensional spacing between the last active inkjet nozzles of one print head and the first active inkjet nozzles of the neighboring print head. This spacing is of critical importance to print quality as it must result in dot positions that span multiple print heads, yet appear as one continuous array.

Figure 3:
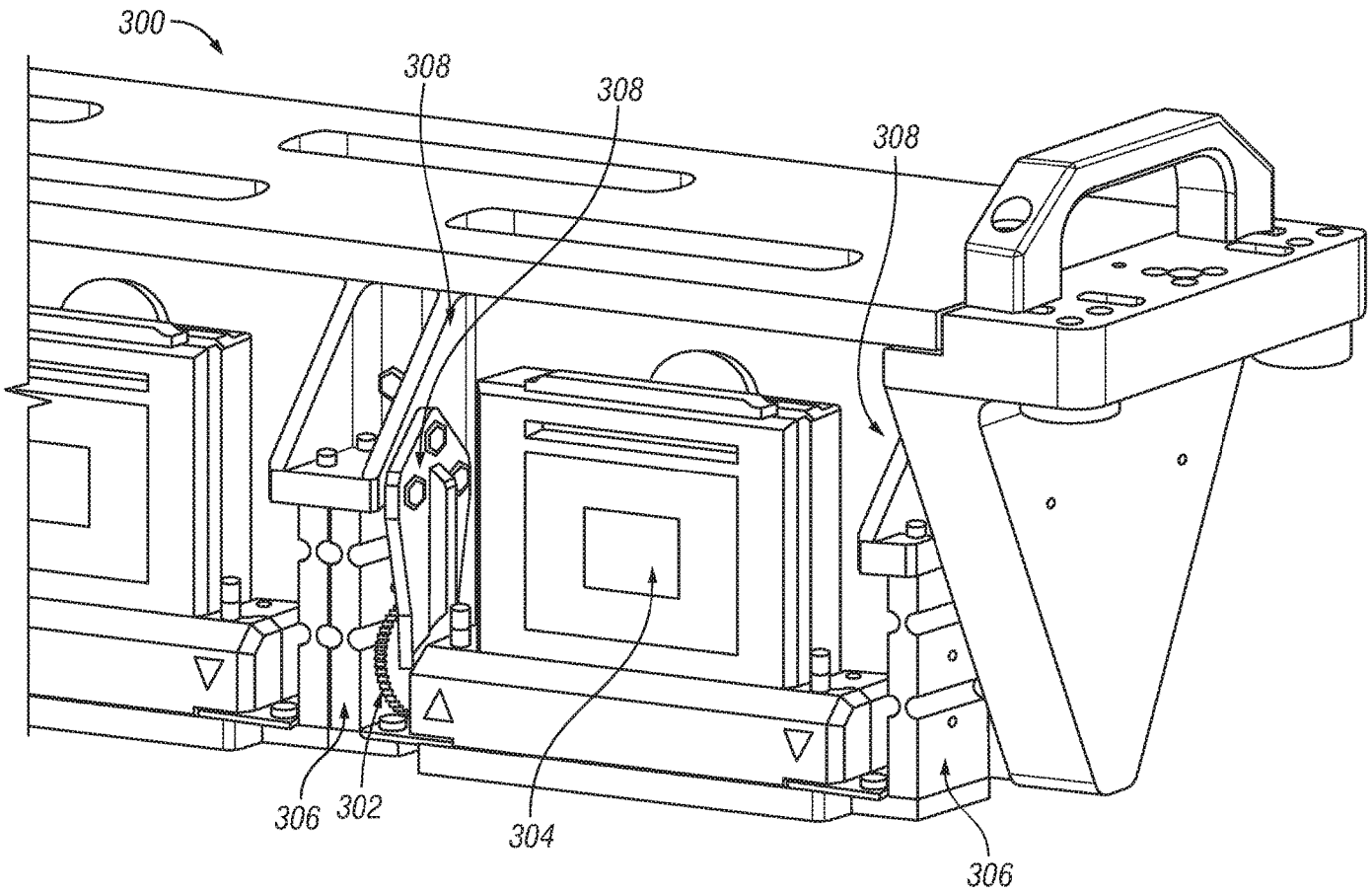
FIG. 3 depicts how an adjustment mechanism can be installed within a printer assembly.

FIG. 3, for example, depicts how an adjustment mechanism 302 can be installed within a printer assembly 300. The adjustment mechanism 302 may be threadably connected to a rigid body 308 and a flexible body 306 (also referred to as an "elastic bending mechanism"), which is connected to a print head 304 (or an array of multiple print heads). The adjustment mechanism 302 can include a differential screw and an indexing wheel 312 that together drive the motion of the flexible body 306, and thus provide a simple way to produce very fine positional displacements.

Figure 4:
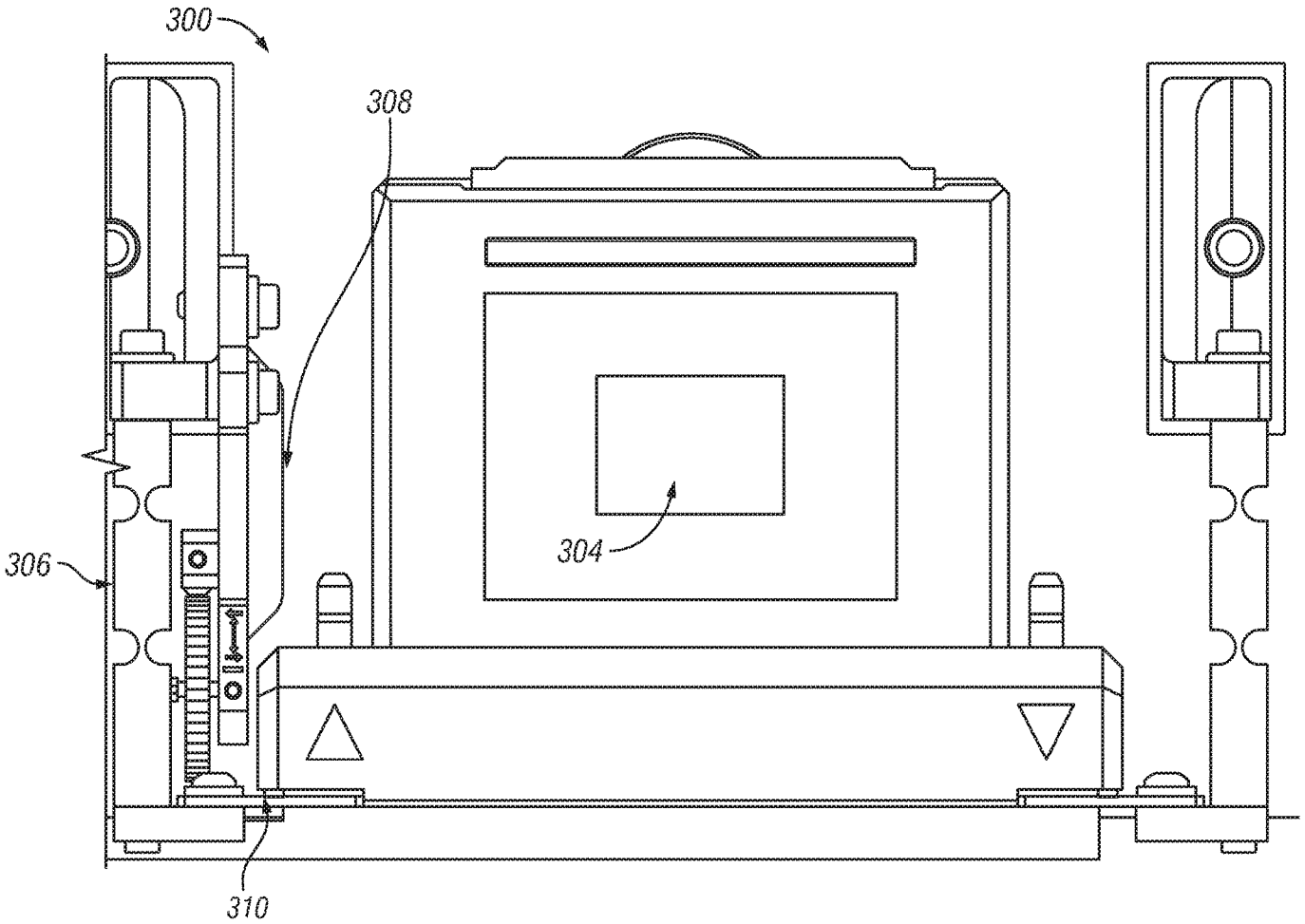
FIG. 4 depicts how a flexible body can be connected, directly or indirectly, to a print head.

FIG. 4 depicts how the flexible body 306 can be connected, directly or indirectly, to a print head 304. Here, for example, the flexible body 306 is connected to the print head 304 via a connecting body 310. Together, the flexible body 306 and the connecting body 310 can form a flexure arrangement having a lower stiffness along a single degree of freedom that is parallel to the driving direction of the print head. The flexure arrangement may have a higher stiffness along the remaining degrees of freedom. Such a configuration allows for very precise rectilinear motion.

Figure 5:
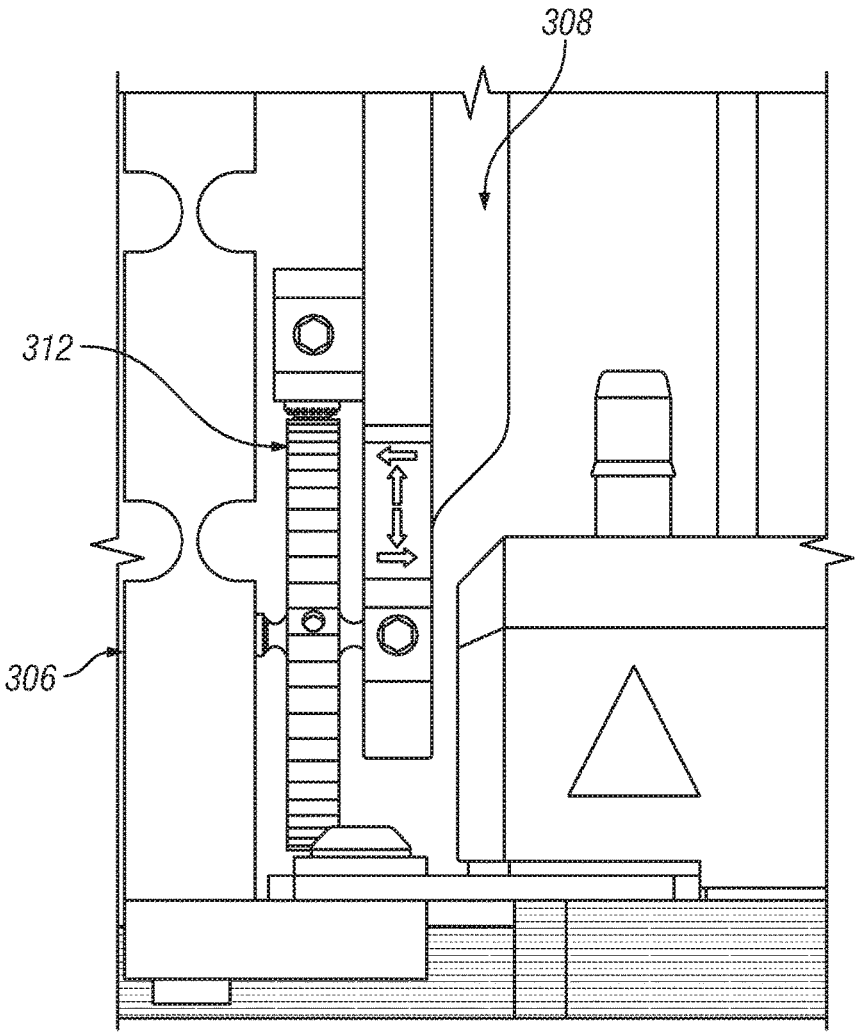
FIG. 5 illustrates how rotating an indexing wheel of an adjustment mechanism causes pressure to be applied to or relieved from a flexible body, thereby causing displacement of a print head.

FIG. 5 illustrates how rotating the indexing wheel 312 of the adjustment mechanism 302 causes tension or compression to be applied to the flexible body 306, thereby causing displacement of the print head 304. As noted above, the flexible body 306 and the fixed body 308 include threaded features having slightly different pitches. A differential screw that includes separate segments having matching pitches interfaces with the threaded features of both the flexible body 306 and the fixed body 308.

In some embodiments, the adjustment mechanism 302 also provides feedback to an individual (e.g., an operator or a technician) in up to three different senses (i.e., visual, audible, and/or tactile feedback). For example, the threaded segments of the differential screw may include geometric features that provide audible feedback and tactile feedback upon rotating the indexing wheel 312 and incrementing based each geometric feature (e.g., detent). In some embodiments, feedback is provided in some subset of the three different senses (e.g., dampening material may be introduced to reduce or eliminate any audible feedback).

Adding geometric features to the differential screw and/or the indexing wheel 312 may provide a user (e.g., an operator or a technician) a better understanding of the number of detents traveled, and therefore a known displacement of the flexible body 306. For example, the rigid body 308 may include a threaded feature designed to receive an M3 screw having a pitch of 0.25 mm, while the flexible body 306 may include a threaded feature designed to receive an M3 screw having a pitch of 0.20 mm. In such embodiments, each revolution of the indexing wheel 312 and the differential screw causes the flexible body 306 to move 0.05 mm (50

μm). Assuming the differential screw includes 50 detents per revolution, rotating the indexing wheel 312 will produce a theoretical displacement of the flexible body 306 of 1 μm per increment. Displacement per detent may be a useful indicator as to the amount of time a user is likely to spend performing an alignment.

Figure 6:
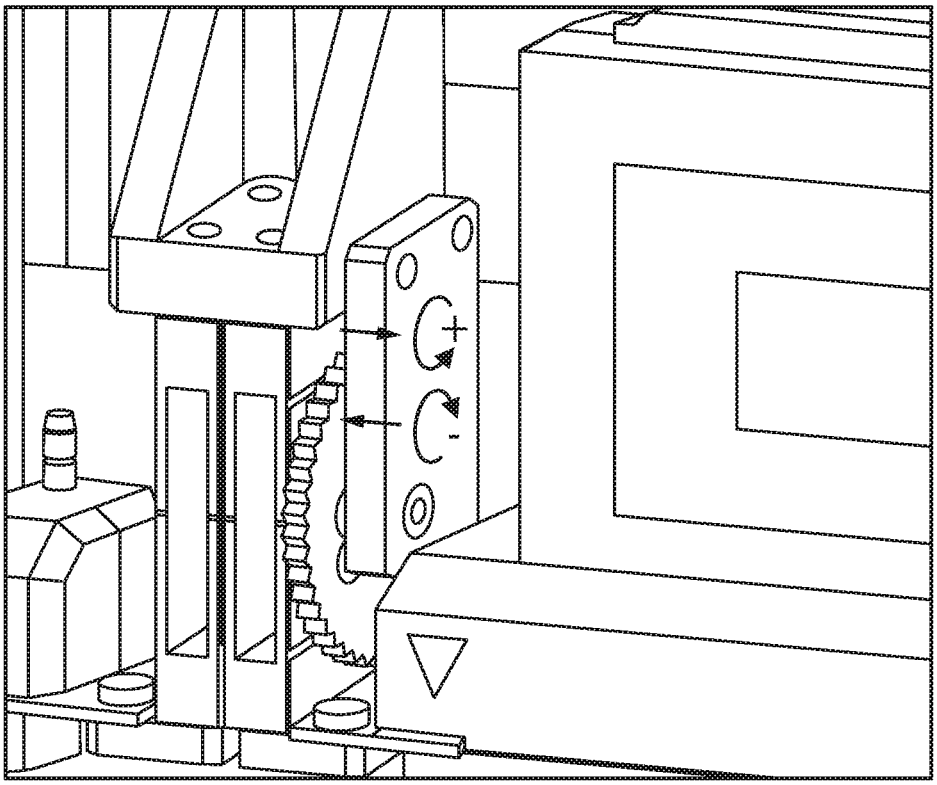
FIG. 6 illustrates how an indexing wheel of an adjustment mechanism can enable fine bidirectional adjustment of the position of a print head.

FIG. 6 illustrates how the indexing wheel 312 of the adjustment mechanism 302 can enable fine bidirectional adjustment of the position of the print head 304. More specifically, rotating the indexing wheel 312 forward may cause rectilinear motion in one direction (i.e., a corresponding stitch direction), while rotating the indexing wheel 312 backward may cause rectilinear motion in the opposite direction (i.e., the opposite stitch direction). Thus, rotation direction can control the direction of displacement of the flexible body 306 (and thus the print head). Such a configuration also enables bi-directional displacement through spinning the indexing wheel 312 in one direction versus the opposite direction.

Figure 7:
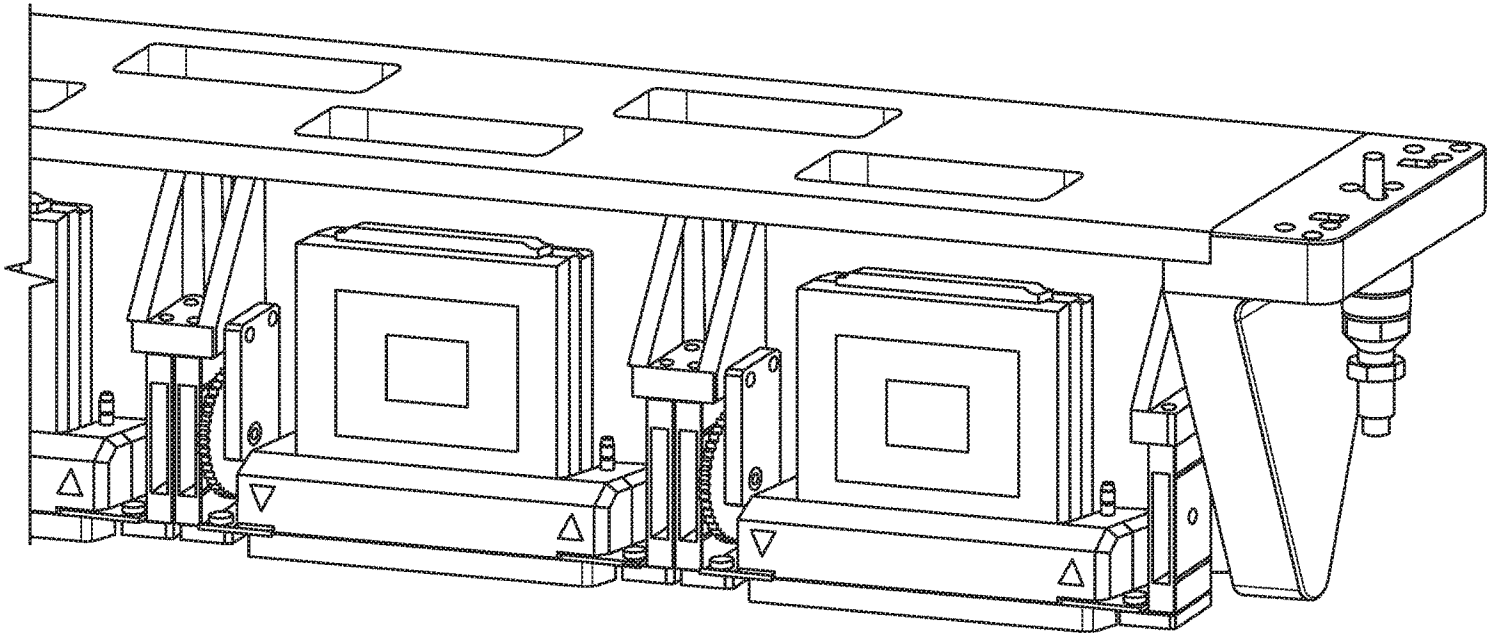
FIG. 7 depicts how the mechanical functionality of an adjustment mechanism may incorporate feedback from a scanner that is connected to the printer assembly and determines dot placement error.

FIG. 7 depicts how the mechanical functionality of an adjustment mechanism may incorporate feedback from a scanner that is connected to the printer assembly and determines dot placement error. Such a configuration enables simple adjustment with notations of print head locations. For example, the scanner may determine the dot placement error upon performing a calibration and depositing ink on a substrate. The adjustment mechanism can then translate the dot placement error (i.e., the amount of error) to a known value of indexing wheel movement(s) in order to achieve printed images of a sufficient or desired quality.

Accordingly, the number of indexing wheel movement(s) may be based on information obtained from the printer assembly, such as information on the placement of ink drops deposited on a substrate. Said another way, measurements of printed targets may indicate the amount of error that needs to be corrected. Here, for example, a scanner alignment target may show that one print head requires ten clicks of "+" adjustment, while another print head requires eight clicks of "−" adjustment.

The position of one or more print heads within a printer assembly may also be automatically adjusted by motorized adjustment mechanisms. In such embodiments, the rotational position of the differential screw may be provided as feedback in the form of encoder counts, the number of indexing wheel movement(s) required, etc.

The adjustment mechanisms described herein allow for excellent positional control of critical features (e.g., a print head within an array of print heads), which reduces the number of adjustments that must be made and the skill level needed to perform installation and alignment tasks.

Figure 8:
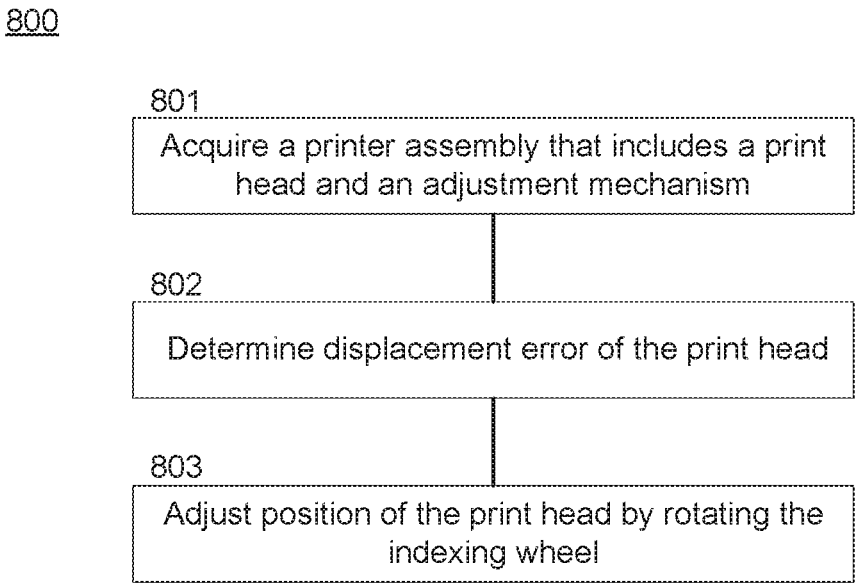
FIG. 8 depicts a process for adjusting the position of a print head within a printer assembly.

FIG. 8 depicts a process 800 for adjusting the position of a print head within a printer assembly. A printer assembly is initially acquired that includes at least one print head and at least one adjustment mechanism (step 801). The adjustment mechanism includes an indexing wheel and a differential screw having a first threaded segment connected to a threaded feature of a rigid body of the printer assembly and a second threaded segment connected to a threaded feature of a flexible body coupled to the print head. The first threaded segment has a first pitch, while the second threaded segment has a second pitch that is different than the first pitch.

In some embodiments, displacement error of the print head is then determined (step 802). For example, a scanner that is connected to the printer assembly may determine dot placement error upon performing a calibration and depositing ink on a substrate. The printer assembly or the adjustment mechanism may then translate the dot placement error to a displacement error of the print head (e.g., a known value of indexing wheel movement(s)). Consequently, measurements of printed targets or the position of certain structural components within the printer assembly may indicate the amount of error that needs to be corrected.

A user (e.g., an operator or a technician) can then adjust the position of the print head by rotating the indexing wheel, which causes tension or compression to be applied to the flexible body (step 803). Each revolution of the indexing wheel causes the flexible body (and thus the print head) to be displaced by a specified amount, which is based on the different between the first pitch of the first threaded segment and the second pitch of the second threaded segment. The indexing wheel of the adjustment mechanism may also enable bi-directional adjustment of the position of the print head.

Figure 9:
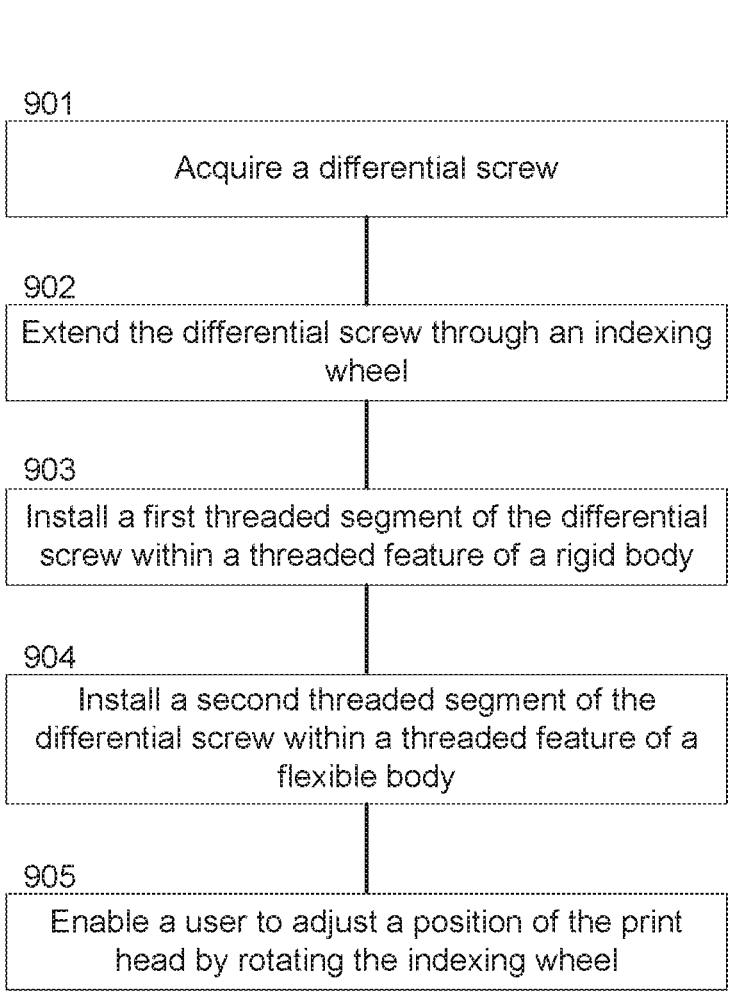
FIG. 9 depicts a process for installing an adjustment mechanism within a printer assembly.

FIG. 9 depicts a process 900 for installing an adjustment mechanism within a printer assembly. A differential screw that includes threaded segments (i.e., a first threaded segment and a second threaded segment) having different pitches is initially acquired (step 901), and then extended through an indexing wheel (step 902).

The first threaded segment of the differential screw is installed within a threaded feature of a rigid body of a printer assembly (step 903). The rigid body may be, for example, a bracket, jet plate, bar, beam, carriage/housing, etc. The second threaded segment of the differential screw is installed within a threaded feature of a flexible body coupled to a print head (step 904). The flexible body may be, for example, a linear flexure that includes one or more structural deformities (i.e., regions of low stiffness), such as notches.

Installation of the adjustment mechanism is such a manner enables a user to adjust the position of the print head by rotating the indexing wheel (step 905), which causes pressure to be applied to or relieved from the flexible body. In some embodiments, the print head is one of an array of print heads that are coupled to the flexible body and move together. User adjustments may also be facilitated by data that specified a displacement error of the print head. The data may be produced by the printer assembly upon printing an image or detecting the position of certain structural component(s) within the printer assembly.

Unless contrary to physical possibility, it is envisioned that the steps described above may be performed in various sequences and combinations. Other steps could also be included in some embodiments. For example, a scanner may track the position of each print head within the printer assembly and specify the appropriate number of indexing wheel movement(s).

Remarks

The above description of various embodiments has been provided for the purposes of illustration and description. It is not intended to be exhaustive or to limit the claimed subject matter to the precise forms disclosed. Many modifications and variations will be apparent to one skilled in the art. One skilled in the relevant technology will also understand that some of the embodiments may include other features that are not described in detail herein. Some well-known structures or functions may not be shown or described in detail below, to avoid unnecessarily obscuring the relevant descriptions of the various examples.

Although the above Detailed Description describes certain embodiments and the best mode contemplated, no matter how detailed the above appears in text, the embodiments can be practiced in many ways. Details of the systems and methods may vary considerably in their implementation details, while still being encompassed by the specification. As noted above, particular terminology used when describing certain features or aspects of various embodiments should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless those terms are explicitly defined herein. Accordingly, the actual scope of the invention encompasses not only the disclosed embodiments, but also all equivalent ways of practicing or implementing the embodiments under the claims.

The language used in the specification has been principally selected for readability and instructional purposes, and it may not have been selected to delineate or circumscribe the inventive subject matter. It is therefore intended that the scope of the invention be limited not by this Detailed Description, but rather by any claims that issue on an application based hereon. Accordingly, the disclosure of various embodiments is intended to be illustrative, but not limiting, of the scope of the embodiments, which is set forth in the following claims.

The invention claimed is:

1. An adjustment mechanism comprising:
a differential screw that includes
a first threaded segment that is connected to a threaded feature of a rigid body of a printer assembly, the first threaded segment having a first pitch, and
a second threaded segment that is connected to a threaded feature of a flexible body coupled to a print head, the second threaded segment having a second pitch; and
an indexing wheel through which the differential screw extends that enables bi-directional adjustment of the print head,
wherein rotating the indexing wheel causes pressure to be applied to or relieved from the flexible body, thereby displacing the print head.

2. The adjustment mechanism of claim 1, wherein each revolution of the indexing wheel causes the print head to be displaced by a specified amount.

3. The adjustment mechanism of claim 2, wherein the specified amount is based on a difference between the first pitch of the first threaded segment and the second pitch of the second threaded segment.

4. The adjustment mechanism of claim 1, wherein stiffness of the flexible body exceeds all possible dynamic loads that could be applied by the differential screw.

5. The adjustment mechanism of claim 1, wherein stiffness of the flexible body is tailored to a single degree of freedom.

6. The adjustment mechanism of claim 1, wherein the flexible body has a lower stiffness along a single degree of freedom that is parallel to a driving direction of the print head.

7. The adjustment mechanism of claim 1, wherein the indexing wheel includes a specified number of detents.

8. The adjustment mechanism of claim 7, wherein rotating the indexing wheel produces a displacement of substantially 1 μm per detent.

9. The adjustment mechanism of claim 1, wherein the first and second threaded segments include geometric features that provide audible feedback and tactile feedback upon rotating the indexing wheel.

10. The adjustment mechanism of claim 1, wherein rotational direction of the indexing wheel controls direction of displacement of the flexible body and the print head.

11. The adjustment mechanism of claim 1, wherein the print head is one of multiple print heads that are simultaneously displaced due to the rotation of the indexing wheel.

12. The adjustment mechanism of claim 1, wherein the print head is part of a print head assembly that is displaced due to the rotation of the indexing wheel, and wherein the print head assembly includes one or more print heads, a jet plate, a print bar, or some combination thereof.

13. A method comprising:
acquiring a printer assembly that includes
a print head, and
an adjustment mechanism that includes
a differential screw having a first threaded segment connected to a threaded feature of a rigid body of the printer assembly and a second threaded segment connected to a threaded feature of a flexible body coupled to the print head, and
an indexing wheel through which the differential screw extends; and
adjusting a position of the print head by rotating the indexing wheel, which causes pressure to be applied to or relieved from the flexible body.

14. The method of claim 13, wherein the first threaded segment has a first pitch, and wherein the second threaded segment has a second pitch different than the first pitch.

15. The method of claim 14, wherein each revolution of the indexing wheel causes the print head to be displaced by a specified amount, and wherein the specific amount is based on a difference between the first pitch of the first threaded segment and the second pitch of the second threaded segment.

16. The method of claim 13, wherein rotating the indexing wheel enables bi-directional adjustment of the position of the print head.

17. A method for installing an adjustment mechanism within a printer assembly, the method comprising:
acquiring a differential screw that includes
a first threaded segment having a first pitch, and
a second threaded segment having a second pitch;
extending the differential screw through an indexing wheel;
installing the first threaded segment of the differential screw within a threaded feature of a rigid body of a printer assembly;
installing the second threaded segment of the differential screw within a threaded feature of a flexible body coupled to a print head; and
enabling a user to adjust a position of the print head by rotating the indexing wheel, which causes tension or compression to be applied to the flexible body.

18. The method of claim 17, wherein rotating the indexing wheel enables bi-directional adjustment of the position of the print head.

19. The method of claim 17, wherein the indexing wheel includes a specified number of detents per revolution.

20. The method of claim 19, wherein rotating the indexing wheel causes displacement per detent of a specified amount.

21. The method of claim 20, wherein the specified amount is based on a difference between the first pitch of the first threaded segment and the second pitch of the second threaded segment.

22. The method of claim 17, wherein the print head is one of an array of print heads that are coupled to the flexible body and move together.

23. The method of claim 17, wherein said enabling is facilitated by data produced by the printer assembly upon printing an image, and wherein the data specifies a displacement error of the print head.

24. The method of claim 17, wherein rotating the indexing wheel in a first direction results in displacement of the flexible member in a corresponding stitch direction, and wherein rotating the differential screw in a second direction results in displacement of the flexible member in an opposite stitch direction.

* * * * *